United States Patent [19]

Jalbing

[11] 3,954,417

[45] May 4, 1976

[54] MONOLITHIC CATALYTIC CONVERTER WITH CENTRAL FLOW TUBE

[75] Inventor: John I. Jalbing, Millington, Mich.

[73] Assignee: General Motors Corporation, Detroit, Mich.

[22] Filed: Aug. 20, 1974

[21] Appl. No.: 498,262

[52] U.S. Cl. ..... 23/288 FC

[51] Int. Cl.[2] ..... B01J 8/02; B01J 35/04; F01N 3/15

[58] Field of Search ..... 23/288 F, 288 FB, 288 FC, 23/288 R; 60/299, 300, 301

[56] References Cited

UNITED STATES PATENTS

| | | | |
|---|---|---|---|
| 1,789,812 | 1/1931 | Frazer | 23/288 FC UX |
| 1,893,372 | 1/1933 | Kryzanowsky | 60/300 X |
| 3,220,179 | 11/1965 | Bloomfield | 23/288 FC UX |
| 3,397,154 | 8/1968 | Talsma | 23/288 F UX |
| 3,682,605 | 8/1972 | Wada | 23/288 R X |
| 3,692,497 | 9/1972 | Keith et al. | 23/288 FC |
| 3,701,823 | 10/1972 | Hardison | 23/288 FB X |
| 3,755,534 | 8/1973 | Graham | 23/288 F X |
| 3,824,788 | 7/1974 | Cole et al. | 23/288 FC UX |

FOREIGN PATENTS OR APPLICATIONS

| | | | |
|---|---|---|---|
| 424,731 | 2/1935 | United Kingdom | 60/299 |
| 413,967 | 7/1934 | United Kingdom | 23/288 FC |

*Primary Examiner*—Morris O. Wolk
*Assistant Examiner*—Marcus Michael S.
*Attorney, Agent, or Firm*—Robert M. Sigler

[57] ABSTRACT

A catalytic converter comprises an annular monolithic catalyst element in a cylindrical can having one closed axial end and a central inlet opening and peripheral outlet openings at the other axial end. The catalyst element has an inner cylindrical surface defining a central axial opening therethrough aligned with the inlet opening. A conduit extends from the inlet opening through the central axial opening of the catalyst element to conduct exhaust gases from the inlet opening to the closed end of the casing for return flow through the catalyst element to the outlet openings. The portion of the exhaust conduit within the central opening of the catalyst element is cylindrical and is spaced slightly away from the inner surface of the catalyst element to define an annular space therebetween, the annular space being so thin as to force exhaust gases leaking therethrough into contact with the inner surface of the catalyst element.

2 Claims, 1 Drawing Figure

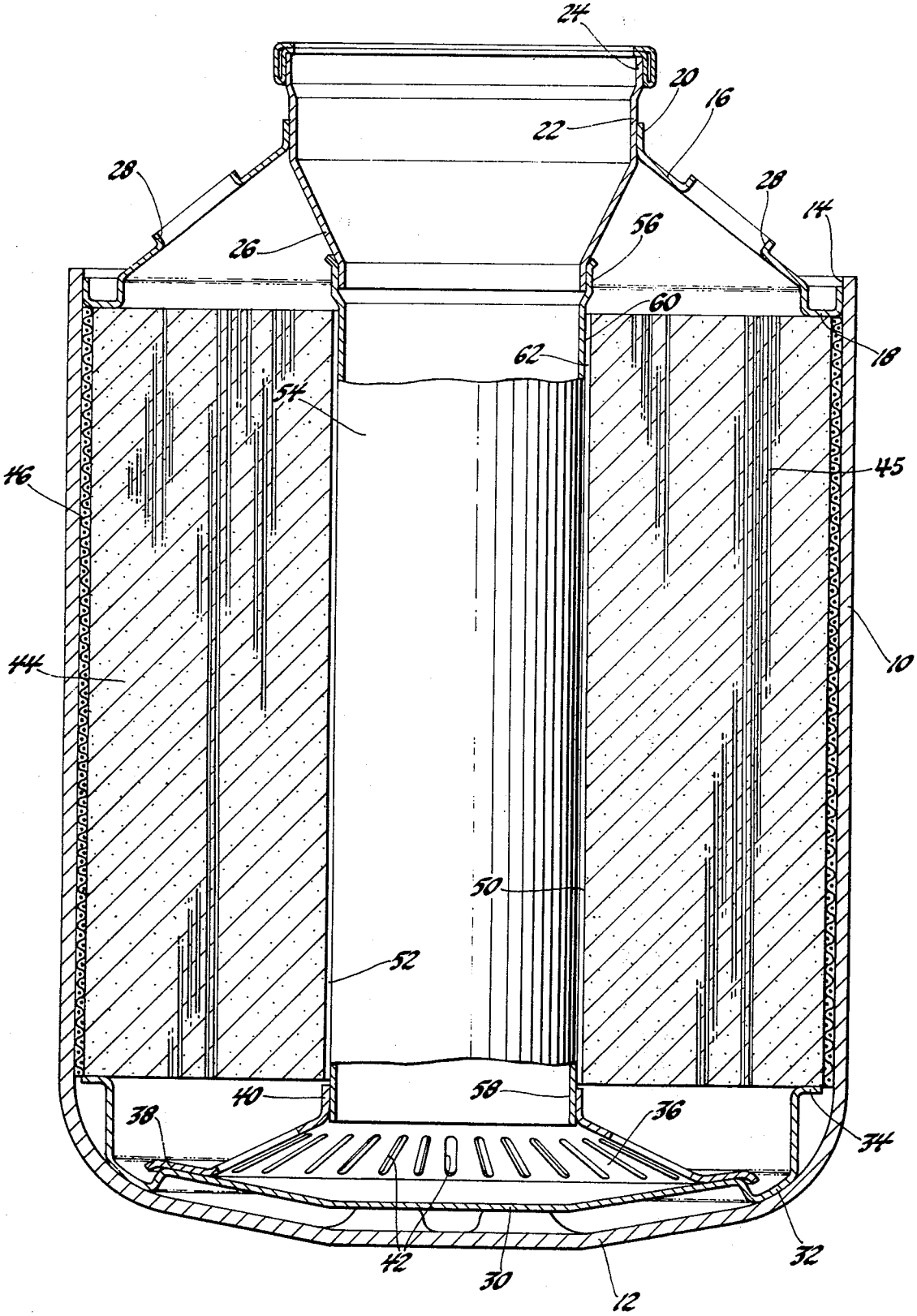
24
20
16
22
28
28
14
26
56
60
18
62
54
46
45
10
44
50
52
40
58
38
36
34
42
30
32
12

MONOLITHIC CATALYTIC CONVERTER WITH CENTRAL FLOW TUBE

SUMMARY OF THE INVENTION

This invention relates to catalytic converters for internal combustion engine exhaust systems and particularly to such converters having annular monolithic catalyst elements in a casing having an inlet and outlet at the same end and being designed to direct the exhaust gases from the inlet through the central opening of the annular catalyst element for return flow through the catalyst element to the outlet.

A particular problem in this converter design is the problem of sealing the exhaust inlet conduit to the monolithic catalyst element, since exhaust gases leaking therebetween near the inlet end of the element may flow to the outlet opening untreated.

This invention, however, dispenses with the need for such a seal by extending the inlet conduit substantially through the central opening in the annular catalyst element. A very thin annular space is left between the conduit and the catalyst element, but any exhaust gases leaking through this space must flow along the full length of the catalyst element before they reach the outlet opening and will therefore not escape untreated. Further details and advantages of this invention will be apparent from the drawing and following description of the preferred embodiment.

DESCRIPTION OF THE PREFERRED EMBODIMENT

Referring to the FIGURE, a catalytic converter comprises an outer casing including a generally cylindrical can 10 having a closed end 12 and an open end 14. An annular end member 16 has its radially outer end formed into an element-stopping flange 18 which fits just inside of open end 14. The radially inner end 20 of end member 16 fits around, and is fixed to, an inlet conduit 22 which is aligned axially with respect to cylindrical can 10 and extends outwardly to form an inlet opening 24 and inwardly to form a funnel section 26. Annular end member 16 has a peripheral ring of outlet openings 28 formed therethrough.

Within cylindrical can 10, at its closed end 12, a heat shield 30 has an encircling rim 32 abutting the can 10 and an element-stopping flange 34 projecting toward the open end 14 of can 10. An annular tube receiver 36 has an outer rim 38 welded to heat shield 30, an inner rim 40 formed into a short cylinder and a ring of openings 42 formed therethrough.

An annular monolithic catalyst element 44, of outer diameter just smaller than can 10, is positioned within can 10 between element-stopping flanges 18 and 34, which seal against the axial ends of element 44 to prevent gas leakage between it and casing 10 as well as stopping movement of element 44 in the axial direction. The element 44 is held in place by cylindrically shaped element retention means 46 located between element 44 and can 10, a typical example of which is shown in this embodiment as a corrugated woven wire mesh.

Catalyst element 44 has an inner cylindrical surface 50 which defines a central cylindrical opening axially aligned with inlet opening 24 and can 10 and extending throughout the entire axial length of element 44.

Element 44 is, in construction, a normal monolithic catalyst element made of a ceramic material which is honeycombed with a large number of generally axial flow paths 45 extending between the axial ends of element 44. The exposed surfaces of element 44 are coated with a substance such as platinum which catalyzes the oxidation of hydrocarbons and carbon monoxide.

A central tube 54, cylindrical in shape, is positioned within central cylindrical opening 52. Central tube 54 has an inlet end 56 which is welded or otherwise rigidly and sealingly engaged with the funnel section 26 of inlet conduit 22 and an outlet end 58 which projects out of the central cylindrical opening toward closed end 12 of can 10 and into inner rim 40 of tube receiver 36. The outer surface 60 of tube 54 and the inner surface 50 of catalyst element 44 define an annular space 62 therebetween. This annular space 62 is desirable since tube 54, made of metal having a higher thermal coefficient of expansion then the ceramic of catalyst element 44, will grow closer to catalyst element 44 as the assembly heats during normal operation. If outer surface 60 of tube 54 were flush with inner surface 50 of element 44 when the assembly is cold, some damage is likely to occur to catalyst element 44 as the unit heats up. Additional factors effecting the size needed for annular space 62 are manufacturing tolerances associated with reasonably inexpensive materials and assembly methods and a possible growth in the outer diameter of tube 54 due to the formation of oxides on outer surface 60.

Annular space 62 must be large enough in radial dimension to satisfy the aforementioned conditions; however, it must be small enough so that substantially all exhaust gases leaking through it from one end of catalyst element 44 to the other are forced into contact with inner surface 50. A typical radial dimension for annular space 62 at normal atmospheric temperatures is 0.04 inch, although this figure is offered as an example only and is not intended as a limitation on the scope of this invention.

It is not necessary for tube 54 to extend completely out of central cylindrical opening 52 in order that substantially all exhaust gas leaking through annular space 62 be brought into contact with catalyst. Obviously, there is an entire range of lengths for tube 54 which will accomplish this purpose to some degree, the degree increasing with the length. However, extending the outlet end 58 of tube 54 out of cylindrical space 52 helps protect catalyst member 44 in two ways. First, any solid particles carried in the exhaust gases which might tend to erode the catalyst element 44 if allowed to impinge on it at high speed are carried past the end of catalyst element 44 before being released into the closed end 12 of can 10. The exhaust gases emerging from outlet end 58 enter a volume of expanding diameter and consequent slowing of gas and particle speed for flow back through catalyst element 44.

The second reason is that outlet end 58, when projecting beyond the end of catalyst element 44, can be held against radial movement by inner rim 40 of tube end receiver 36 to prevent it from swinging into contact with, and possibly damaging, catalyst element 44 when subjected to vibration.

Although outlet end 58 is held by tube end receiver 36 against radial movement, it is free to move axially with respect to tube end receiver 36 as the different parts of the converter assembly expand and contract at differing rates with temperature changes.

The embodiment as described is only a preferred embodiment of this invention. Since equivalent embodiments will occur to those skilled in the art, this invention should be limited only by the claims which follow.

I claim:

1. Apparatus for catalytically treating engine exhaust gases comprising:

a casing having a generally cylindrical body with a closed axial end and an open axial end;

an annular cover member having an outer perimeter flange engaging the open end of the casing and providing an axial catalyst element support and an inner periphery providing a central tube support, the annular cover member having one or more openings therethrough between the inner periphery and outer perimeter flange defining an outlet for engine exhaust gases from the apparatus;

an axial catalyst element support member within the casing adjacent its closed end, the axial catalyst element support member having an annular rim abutting the closed end of the casing and an annular flange radially outside the annular rim, spaced from the closed end of the casing and effective to define an axial catalyst element support;

an annular circumferential catalyst element support member within the casing abutting the cylindrical body and defining a circumferential catalyst element support;

an annular monolithic catalyst element supported within the casing axially between the outer perimeter flange of the annular cover member and the annular flange of the axial catalyst support member and circumferentially within the circumferential catalyst element support member, the catalyst element having an inner cylindrical surface defining an axial opening therethrough, the catalyst element having a honeycomb structure defining a plurality of axial flow paths therethrough and coated with a catalyst substance within the flow paths and on the inner cylindrical surface for the treatment of exhaust gases flowing through the flow paths and contacting the inner cylindrical surface; and a tube having one end sealingly engaged to and supported by the inner perimeter of the annular cover member to form an inlet for exhaust gases into the apparatus and extending through the axial opening of the catalyst element for substantially its entire length to another end to conduct exhaust gases to the closed end of the casing for return flow through the flow paths to the outlet, the tube being radially spaced from the inner cylindrical surface by only the distance required to allow normal relative radial thermal expansion and contraction between the tube and catalyst element, whereby some gases are allowed to leak therebetween from the closed end of the casing to the outlet but gases so leaking are brought into contact with the inner cylindrical surface of the catalyst element for substantially its entire length and are thus substantially completely catalytically treated so that no seal is required between tube and catalyst element.

2. Apparatus for catalytically treating engine exhaust gases comprising:

a casing having a generally cylindrical body with a closed axial end and an open axial end;

an annular cover member having an outer perimeter flange engaging the open end of the casing and providing an axial catalyst element support and an inner periphery providing a central tube support, the annular cover member having one or more openings therethrough between the inner periphery and outer perimeter flange defining an outlet for engine exhaust gases from the apparatus;

an axial catalyst element support member within the casing adjacent its closed end, the axial catalyst element support member having an annular rim abutting the closed end of the casing and an annular flange radially outside the annular rim, spaced from the closed end of the casing and effective to define an axial catalyst element support;

an annular circumferential catalyst element support member within the casing abutting the cylindrical body and defining a circumferential catalyst element support;

an annular monolithic catalyst element supported within the casing axially between the the outer perimeter flange of the annular cover member and the annular flange of the axial catalyst support member and circumferentially within the circumferential catalyst element support member, the catalyst element having an inner cylindrical surface defining an axial opening therethrough, the catalyst element having a honeycomb structure defining a plurality of axial flow paths therethrough and coated with a catalyst substance within the flow paths and on the inner cylindrical surface for the treatment of exhaust gases flowing through the flow paths and contacting the inner cylindrical surface;

a tube having one end sealingly engaged to and supported by the inner perimeter of the annular cover member to form an inlet for exhaust gases into the apparatus and extending through the axial opening of the catalyst element for substantially its entire length to another end to conduct exhaust gases to the closed end of the casing for return flow through the flow paths to the outlet, the tube being radially spaced from the inner cylindrical surface by only the distance required to allow normal relative radially thermal expansion and contraction between the tube and catalyst element, whereby some gases are allowed to leak therebetween from the closed end of the casing to the outlet but gases so leaking are brought into contact with the inner cylindrical surface of the catalyst element for substantially its entire length and are thus substantially completely catalytically treated so that no seal is required between tube and catalyst element; and an annular tube receiving member having an outer peripheral rim fixed to the axial catalyst support element, an inner rim engaging the other end of the tube and a plurality of openings therethrough to permit exhaust gas flow from the other end of the tube to the catalyst element.

* * * * *